US005419020A

United States Patent [19]

Murai

[11] Patent Number: 5,419,020

[45] Date of Patent: May 30, 1995

[54] SEPARABLE BUCKLE

[75] Inventor: Ryukichi Murai, Toyama, Japan

[73] Assignee: Yoshida Kogyo K.K., Tokyo, Japan

[21] Appl. No.: 176,410

[22] Filed: Dec. 20, 1993

[30] Foreign Application Priority Data

Dec. 25, 1992 [JP] Japan ..... 4-092868 U

[51] Int. Cl.[6] ..... A44B 11/25

[52] U.S. Cl. ..... 24/625; 24/633

[58] Field of Search ..... 24/625, 633, 614, 615, 24/616

[56] References Cited

U.S. PATENT DOCUMENTS 5,144,725 9/1992 Krauss ..... 24/633 X
5,311,649 5/1994 Suh ..... 24/635 X

FOREIGN PATENT DOCUMENTS 0204250 12/1986 European Pat. Off. .
0386783 9/1990 European Pat. Off. .
0427525 5/1991 European Pat. Off. .
4-221502 8/1992 Japan .

*Primary Examiner*—James R. Brittain
*Attorney, Agent, or Firm*—Hill, Steadman & Simpson

[57] ABSTRACT

A buckle comprising a plug having a base plate and a pair of resilient arms extending forward from the base plate; each arms having a coupling hook; a socket including a pair of upper and lower walls to define therebetween a chamber for receiving the arms and a pair of coupling lugs mounted in the chamber; as inserted into the chamber, the arms being first compressed laterally thereof by the lugs against its own resiliency and, after the coupling hooks pass beyond the respective lugs expanded under its own resiliency to bring the coupling hooks into coupling engagement with the coupling lugs; and a lock member mounted in the chamber so as to reciprocally move between a locking position and an unlocking position; the lock member comprising two or first or second pairs of locking members, each locking member in each pair being opposed to the other locking member, respectively, in said each pair; the lock member resiliently fitted in an elongated aperture of the upper wall, with the first and second locking members of the lock member adapted to come into locking engagement with the opposed locking means formed in the edge of the through aperture to thus selectively lock the lock member in the locking position and the unlocking position.

3 Claims, 4 Drawing Sheets

SEPARABLE BUCKLE

BACKGROUND OF THE INVENTION

1. Field of the Invention

The present invention relates generally to a buckle used for joining a belt incorporated in clothes, baggages, canteens and so forth and particularly to such a buckle equipped with a lock member for locking a plug and a socket of the buckle in coupled disposition.

2. Prior Art

A typical buckle of the type described is disclosed in Japanese patent laid-open publication No. 4-221502. This disclosed buckle generally comprises a plug having a pair of parallel resilient arms, a socket being in the form of a rectangular casing for receiving the arms and having a pair of openings one formed in each side thereof. Each arm has a prong on its tip and each side opening has a coupling edge. As the arms of the plug is inserted into the socket, the arms first are compressed toward each other against their resiliency and, as soon as the prongs reach the openings, the arms are restored to its original shape under their resiliency to thus bring the prongs into coupling engagement with the coupling edge. The buckle further includes a lock member. The lock member is mounted on one side of the socket so as to reciprocally move between a locking position where the prongs of the arms of the plug are restrained from coming out of coupling engagement with the opening edge of the socket and an unlocking position in which the plugs are allowed to come out of engagement with the opening edge. The locking member has a pair of juxtaposed recesses formed on its rear side. A resilient cantilevered tongue with a locking detent at its distal end is provided on said one side of the socket. The locking detent is normally urged under the resiliency of the resilient cantilevered tongues against the rear side of the locking member for locking engagement with the recesses on its rear side; the locking member is set relative to the socket such that, when the detent comes into locking engagement with one recess, the locking member is in the locking position and when the detent comes into locking engagement with the other recess, the locking member is in the unlocking position.

However, this buckle suffers from drawbacks. The locking of the locking member is effected by a unidirectional bias exerted by the resilient cantilevered tongue so that the locking member is susceptible to come off the locking position accidentally. Furthermore, the bias of the resilient cantilevered tongue provides an increased frictional resistance which makes sluggish the reciprocation of the lock member on the socket.

SUMMARY OF THE INVENTION

With the foregoing difficulties in view, it is therefore an object of the present invention to provide a buckle comprising a plug, a socket and a lock member, wherein the lock member can be firmly locked both in locking position wherein the plug and the socket is prevented from being uncoupled from each other and in unlocking position wherein the plug and the socket is allowed to be uncoupled from each other.

According to the present invention, there is provided a buckle comprising a plug having a base and a pair of resilient, substantially parallel arms extending forward from the base; each resilient arms having a coupling hook; a socket including a pair of upper and lower walls to define therebetween a chamber for receiving the arms and a pair of coupling lugs mounted in the chamber; as inserted into the chamber, the arms being first compressed laterally thereof by the lugs against their own resiliency and, as soon as the coupling hooks pass beyond the respective lugs, expanded under their own resiliency to bring the coupling hooks into coupling engagement with the coupling lugs; and a lock member mounted in the chamber so as to reciprocally move between a locking position where the lock member comes between the arms to thus prevent the resilient arms from being contracted and an unlocking position where the lock member withdraws from between the arms; the lock member comprising a base plate, an elongated lock body mounted on one surface of the slide plate and two or first or second pairs of locking members formed on sides of the lock body, each locking member in each pair being opposed to the other locking member, respectively, in said each pair, the upper wall having an elongated through aperture formed therein and a pair of opposed locking means formed on the opposed positions on the inner edge of the elongated through aperture, the slide plate being reciprocally mounted on the upper wall and the lock body fitting in the elongated aperture, with the first and second locking members of the lock body adapted to come into locking engagement with the opposed locking means to thus selectively lock the lock member in the locking position and the unlocking position.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRITPION

Figure 1:
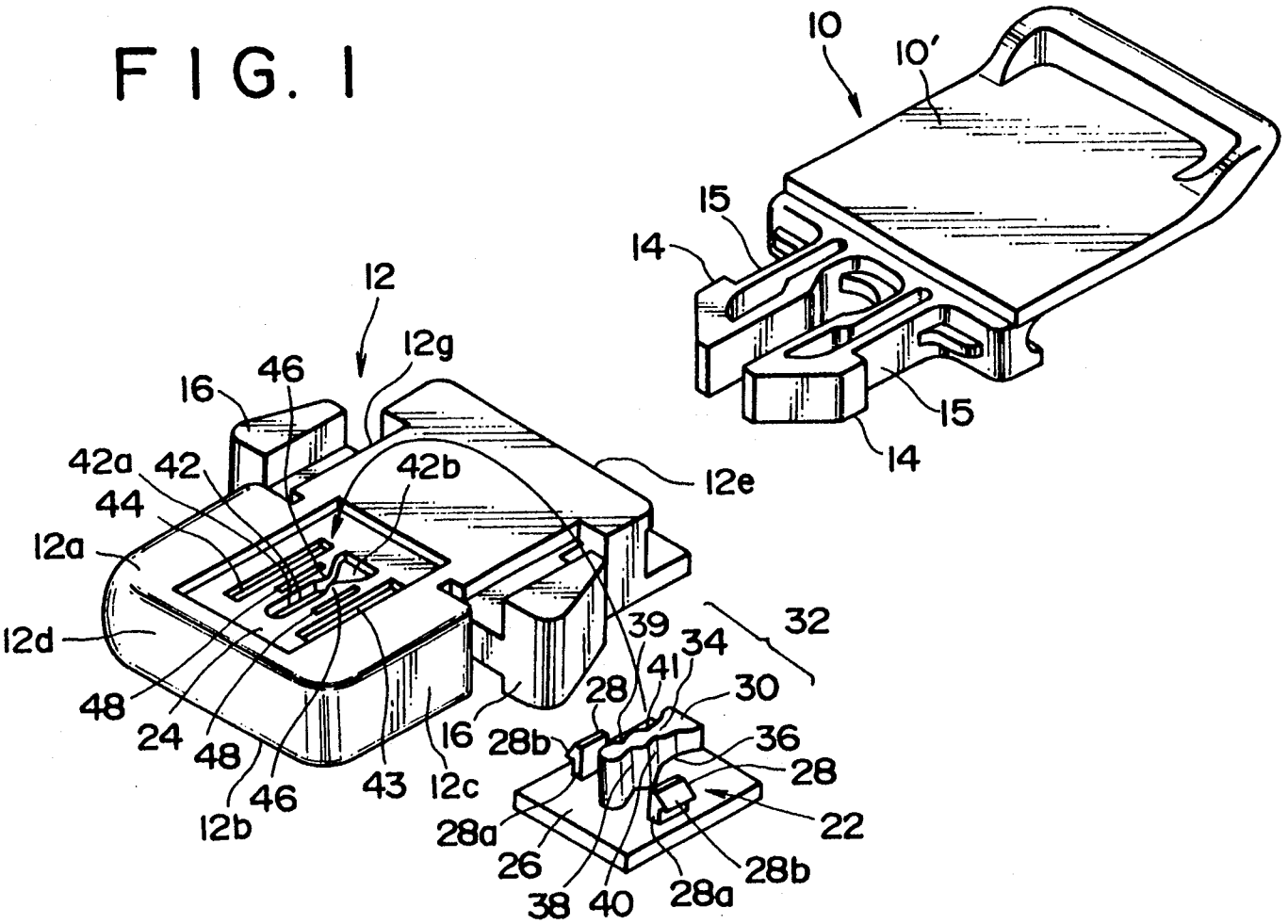
FIG. 1 is an exploded perspective view of a buckle according to the present invention.

As better shown in FIG. 1, a buckle according to the present invention broadly comprises a plug or a male member 10 and a socket or a female member 12, both made of plastics. The plug 10 is attached to for example one end of a belt (not shown) and the socket 12 is attached to the other end of the belt (not shown). The plug 10 comprises a flat base plate 10' and a pair of parallel spaced arms 15, 15 formed integrally with and extending forward from a front end of the base plate 10'. A pair of coupling hooks 14, 14 provided one on each arm 15 at a distal end thereof, the hooks 14, 14 being oriented away from each other.

The socket 12 is in the shape of a hollow rectangular box and comprises a pair of upper and lower walls **12*a*, 12*b*, a pair of side walls 12*c*, 12*c* each connected with the side edges of the upper and lower walls 12***a*, 12*b* and a rear wall 12*c* connected with the rear ends of the upper and lower walls 12*a*, 12*b*, to thus define a chamber 12*f*. The socket 12 has at a front end an opening 12*e* which communicates with the chamber 12*f*. Each side wall 12*c* has an indentation 12*g* formed at its intermediate position. A pair of cantilevered actuating levers 16, 16 extend rearward from the respective side walls 12*c*, 12*c* adjacent to the opening 12*e*. The levers 16, 16 are movable angularly perpendicularly to the direction in which the plug 10 is inserted. A pair of coupling lugs 18, 18 are mounted integrally with the upper and lower walls 12*a*, 12*b* of the socket 12. The positions of the lugs 18, 18 are such that the coupling hook 14,14 come into coupling engagement with the respective coupling lugs 18, 18 under the resiliency of the resilient arms 15, 15 when the arms 15, 15 are inserted into the chamber 12f, as closely described hereinafter. The opposed actuating levers 16, 16 have the respective rear end portions turned toward each other to provide projecting abutments 20, 20. The projecting abutments 20, 20 are normally urged toward each other by resiliency of the resilient levers 16, 16 for abutting engagement with the coupling hooks 14, 14 when the coupling hooks 14, 14 comes into coupling engagement with the coupling lugs 18, 18. The upper wall 12*a* has a rectangular recessed flat surface 24 on its outer side. A T-shaped through aperture 42 is formed in its middle of the rectangular recessed surface 24. The T-shaped through aperture 42 includes a longitudinal aperture part 42*a* extending longitudinally of the socket 12 and a lateral aperture part 42*b* having its middle connected with that end of the longitudinal aperture part 42*a* which is closer to the opening 12*e*. The longitudinal aperture part 42*a* has a pair of opposed locking projections 46, 46 formed in its inner edge on its opposed positions so as to project toward each other. A pair of guide slots 43, 44 are formed one on each side of the longitudinal aperture part 42*a* so as to extend in parallel with the longitudinal aperture part 42*a*. Additionally, a pair of slits 48, 48 are formed each between the longitudinal aperture part 42*a* and the respective guide slots 43, 44 so as to extend in parallel with the longitudinal aperture part 42*a* and the guide slots 43, 44.

The buckle further includes a lock member 22. The lock member 22 generally includes a flat substantially square base plate 26, a T-shaped lock body 32 mounted on the middle thereof and a pair of attachment hooks 28, 28 mounted one on each side of the T-shaped lock body 32. The T-shaped lock body 32 includes a longitudinal part 34 and a lateral detent part 32 having its middle perpendicularly connected to one end of the longitudinal lock portion 30. Two or first or second pairs of locking grooves or locking members 38, 39; 40, 41 are formed on opposed sides of the longitudinal part 34, each locking groove 38, 40 in each pair 38, 39; 40, 41 being opposed to the other 39, 41 respectively, in said each pair 38, 39; 40, 41. Each attachment hook 28 has a leg portion 28*a* vertically mounted on the base plate 26 and a prong 28*b* formed integrally with the top end of the leg portion 28*a*. The prongs 28*b* of the opposed attachment hooks 28 are directed away from each other.

Figure 7:
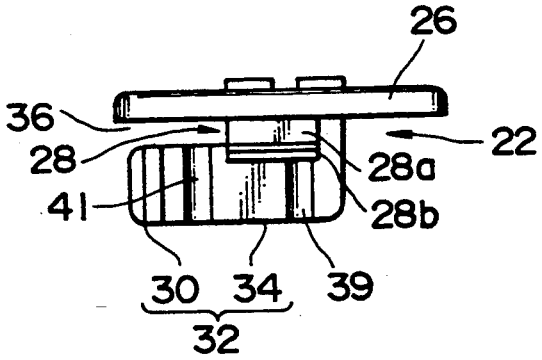
FIG. 7 is a front view of the lock member.

The lock member 22 of the construction set forth above is reciprocally mounted on the recessed surface 24 with the T-shaped lock body 32 inserted into the T-shaped through aperture 42, the attachment hooks 28, 28 inserted into the respective guide slots 43, 44. As better seen in FIG. 7, the T-shaped lock body 32 has an indentation 36 formed between the lateral detent part 36 and the base plate 26 which lets the recessed slide surface 24 therein when the lock member 22 slides along the recessed slide surface 24 toward the opening 12*e*. This permits the T-shaped lock body 32 along the T-shaped aperture 42. With the lock body 32 resiliently fitted through the through aperture 42, the first and second locking grooves 38, 39; 40, 41 of the lock body 21 are adapted to come into resilient locking engagement with the opposed locking projections 46, 46 formed on the inner edge of the T-shaped through aperture 42, to thus resiliently and selectively lock the lock member 22 in locking position and the unlocking position, respectively. The slits 48, 48 are intended to provide resiliency to locking projections 46, 46.

Figure 4:
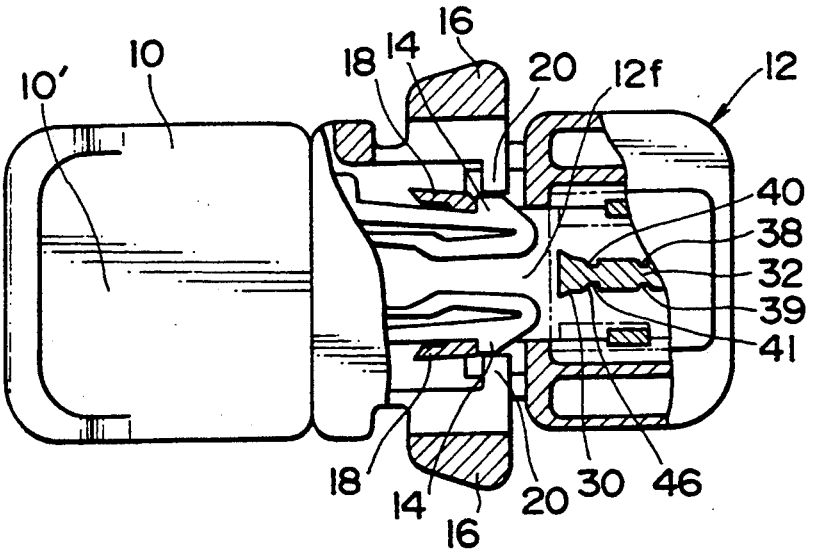
FIG. 4 is a plan view, partly cross-sectional, of the buckle of FIG. 1, showing a lock member assuming an unlocking position.
Figure 5:
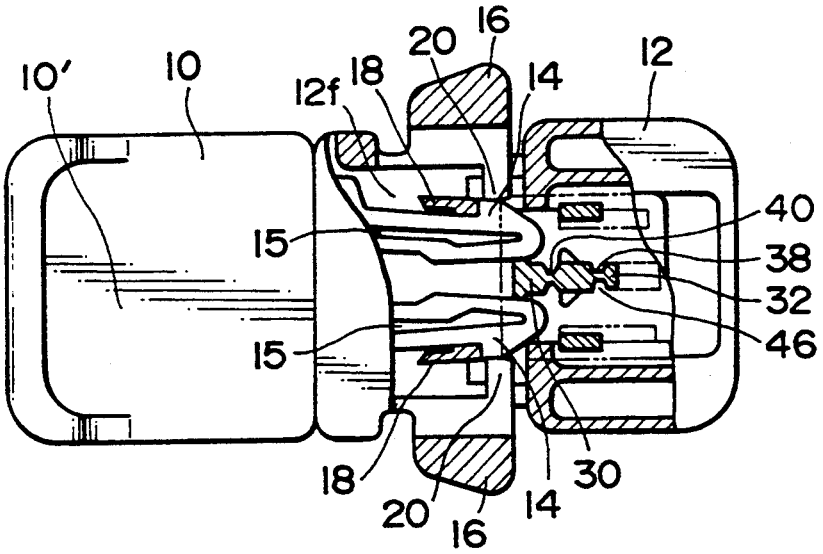
FIG. 5 is a view similar to FIG. 4, but showing the lock member assuming a locking position.
Figure 6:
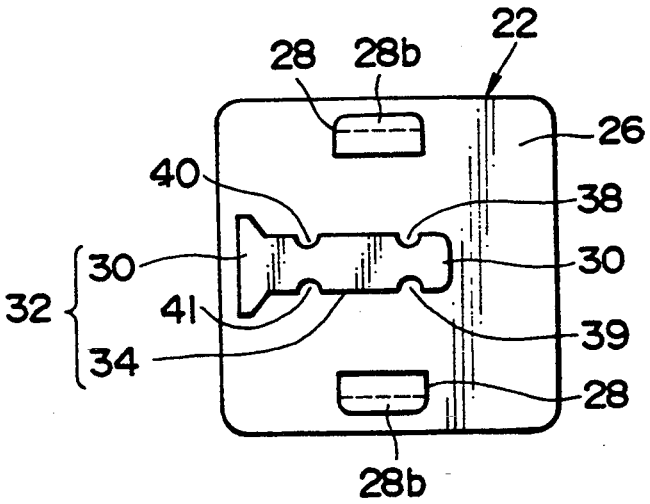
FIG. 6 is a base view of the lock member.

Referring now to how to use the buckle according to the present invention; as shown in FIG. 4, firstly the parallel arms 15, 15 of the plug 10 is inserted through the opening 12*e* into the chamber 12*f* of the socket 12. As inserted into the chamber 12*f*, the arms 15, 15 are first compressed laterally thereof by the lugs 18, 18 against its own resiliency and, as soon as the coupling hooks 14, 14 pass beyond the respective lugs, 18, 18, are expanded under its own resiliency to thus bring the coupling hooks 14, 14 into coupling engagement with the coupling lugs 18, 18, whereupon the plug 10 is coupled with the socket 12.

Figure 2:
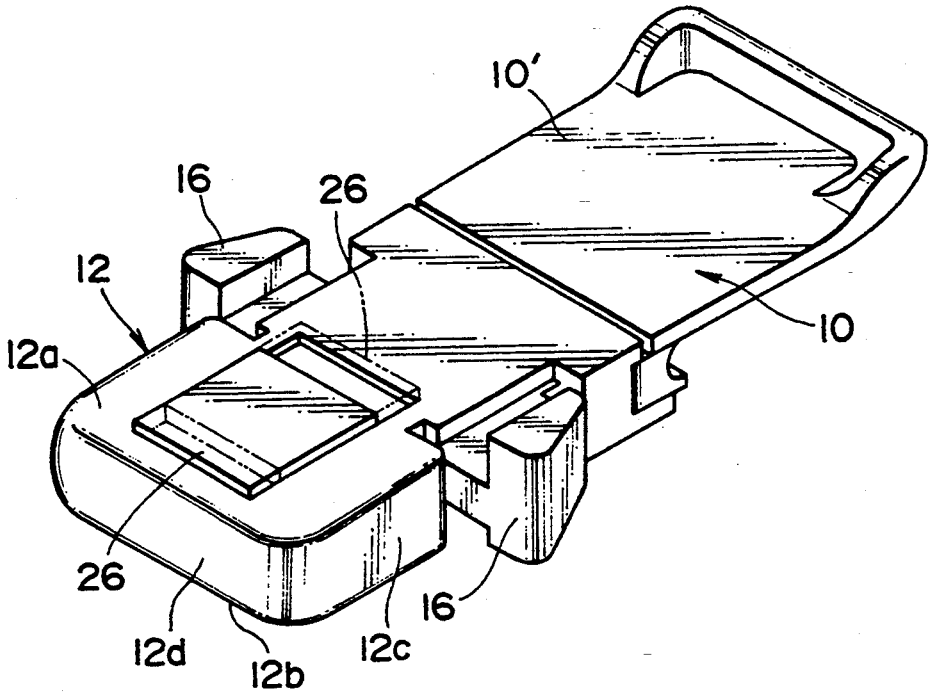
FIG. 2 is a perspective view showing a plug and a socket of the buckle of FIG. 1 to be coupled.
Figure 3:
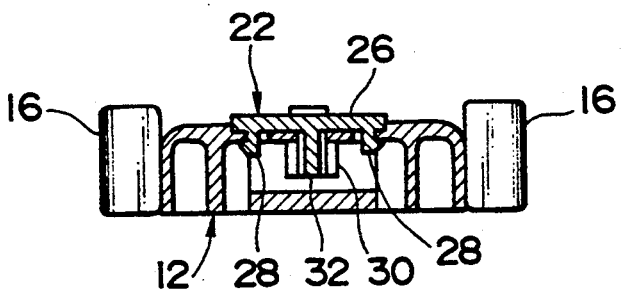
FIG. 3 is a longitudinal cross-sectional view of the socket of the buckle of FIG. 1.

For locking the plug 10 and the socket 12 in such coupling state; as shown in FIG. 2, the base plate 28 is slit along the recessed surface 24 away from the opening 12*e* of the socket 12 with the attachment hook 28 guided through the respective guide slots 43, 44, until the lock member 22 assumes a locking position in which the first pair of locking grooves 38, 39 come into locking engagement with the opposed locking projections 46, 46 and at the same time the lateral detent part 34 of the T-shaped lock body 32 comes between the parallel arms 15, 15; as shown in FIG. 4. Wedged between the parallel arms 15, 15, the lateral detent part 34 of the T-shaped lock body 32 prevents the parallel arms 15, 15 from coming toward each other and from bring the coupling hooks 14, 14 out of coupling engagement with the respective coupling lugs 18, 18 of the socket 12. Consequently, the plug 10 and the socket 12 have been firmly locked to each other in coupled disposition.

For unlocking the plug 10 and the socket 12, the base plate 26 of the lock member 22 is slid along the recessed surface 24 in the opposite direction or toward the opening 12*e* of the socket 12 until the lock member 22 assumes an unlocking position wherein the second pair of locking grooves 40, 41 come into locking engagement with the opposed locking projections 46, 46 and at the same time the lateral detent portion 34 of the T-shaped lock body 32 is withdrawn from between the parallel arms 15, 15, as shown in FIG. 4. Then, the actuating levers 16, 16 are compressed by fingers against the resiliency of the resilient arms 15, 15 of the plug 10 to thus bring the coupling hooks 14, 14 out of coupling engagement with the respective coupling lugs 18, 18. As soon as the coupling hooks 14, 14 comes out of coupling engagement with the respective coupling lugs 18, 18, the plug 10 pops out of the socket 12 under the resiliency of the resilient arms 14, 14.

Although the projections 46, 46 are formed on the edge of the through aperture 42 of the socket 12 and the grooves 38, 39; 40, 41 are formed on the opposed sides of the lock body 32 in the preceding embodiment; alternatively, a pair of opposed grooves may be formed on the edge of the through aperture of the socket and two pairs of projections may be formed on the opposed sides of the lock body.

With the construction set forth above, the invention enjoys the following advantages.

Since the locking projections exert locking forces onto the locking grooves bidirectionally from the opposite sides, the lock member can be much more securely locked relative to the socket both in locking position wherein the plug and the socket are prevented from being uncoupled from each other and in unlocking position wherein the plug and the socket is allowed to be uncoupled from each other even under severe stresses exerted on the lock member.

Since the locking projections exert locking forces onto the locking grooves bidirectionally from the opposite sides, the locking forces completely cancel out, thus saving unnecessary or biased force, which could, otherwise, adversely affect the function of the lock member. This advantageously insures that the lock member can operate smoothly for prolonged period of time.

Obviously, various modifications and variations of the present invention are possible in the light of the above teaching. It is therefore to be understood that within the scope of the appended claims the invention may be practiced otherwise than as specifically described.

What is claimed is:

1. A buckle comprising a plug having a base and a pair of resilient, substantially parallel arms extending forward from the base; each resilient arm having a coupling hook; a socket including a pair of upper and lower walls to define therebetween a chamber for receiving the arms and a pair of coupling lugs mounted in the chamber; as inserted into the chamber, the arms being first compressed laterally thereof by the lugs against their own resiliency and, as soon as the coupling hooks pass beyond the respective lugs, expanded under their own resiliency to bring the coupling hooks into coupling engagement with the coupling lugs; and a lock member mounted in the chamber so as to reciprocally move between a locking position where the lock member comes between the arms to thus prevent the resilient arms from being contracted and an unlocking position where the lock member withdraws from between the arms; the lock member comprising a base plate, an elongated lock body mounted on one surface of the base plate and first and second pairs of locking members formed on sides of the elongated lock body, each locking member in each pair being opposed to the other locking member, respectively, in said each pair, the upper wall having an elongated through aperture formed therein and a pair of opposed locking means formed on the opposed positions on the inner edge of the elongated through aperture, the base plate being reciprocally mounted on the upper wall and the lock body fitting in the elongated aperture, with the first and second pairs of locking members of the lock body adapted to come into locking engagement with the opposed locking means to thus selectively lock the lock member in the locking position and the unlocking position respectively.

2. A buckle according to claim 1, wherein said locking means comprises a pair of opposed locking projections formed on the opposed positions in the inner edge of the elongated aperture, so as to project toward each other, the pairs of locking members comprising two pairs of locking grooves formed on sides of the elongated lock body.

3. A buckle according to claim 1, wherein said locking means comprises a pair of opposed locking grooves formed in the opposed positions in the inner edge of the elongated aperture, the pairs of locking members comprising two pairs of locking projections formed on sides of the elongated lock body.

* * * * *